US007914386B1

(12) United States Patent
Johns et al.

(10) Patent No.: US 7,914,386 B1
(45) Date of Patent: Mar. 29, 2011

(54) BUCKING HORSE SIMULATOR APPARATUS

(76) Inventors: Stanlo J. Johns, Okeechobee, FL (US); Robert E. Chalfant, Okeechobee, FL (US)

( * ) Notice: Subject to any disclaimer, the term of this patent is extended or adjusted under 35 U.S.C. 154(b) by 137 days.

(21) Appl. No.: 12/454,359

(22) Filed: May 18, 2009

(51) Int. Cl.
*A63G 13/06* (2006.01)
*A63G 13/00* (2006.01)

(52) U.S. Cl. ..... 472/95; 472/96; 472/101; 472/3; 434/247

(58) Field of Classification Search ..... 472/3, 95–96, 472/101, 103, 135; 434/55, 247; 482/51, 482/52, 54, 57, 77
See application file for complete search history.

(56) References Cited

U.S. PATENT DOCUMENTS

| | | | | |
|---|---|---|---|---|
| 1,784,183 | A | 12/1930 | Fike | |
| 2,843,380 | A | 7/1958 | Simon et al. | |
| 2,908,500 | A * | 10/1959 | Yetter | 472/97 |
| 3,997,979 | A | 12/1976 | Turner | |
| 4,519,787 | A | 5/1985 | Williams | |
| 5,085,425 | A * | 2/1992 | Collins et al. | 472/97 |
| 5,180,338 | A * | 1/1993 | Pinto | 472/96 |
| 5,429,515 | A * | 7/1995 | Greenwood | 434/247 |
| 6,059,666 | A * | 5/2000 | Ohara et al. | 472/97 |
| 6,402,626 | B1 | 6/2002 | Beaty | |
| 6,808,458 | B1 * | 10/2004 | Jung | 472/97 |
| D507,312 | S | 7/2005 | Nishiyama et al. | |
| 6,964,614 | B1 * | 11/2005 | Tsai | 472/58 |
| 7,608,017 | B2 * | 10/2009 | Nakanishi | 482/51 |
| 7,736,240 | B2 * | 6/2010 | Chuang et al. | 472/97 |
| 7,775,939 | B2 * | 8/2010 | Nakanishi | 482/51 |

* cited by examiner

*Primary Examiner* — Kien T Nguyen

(57) ABSTRACT

A bucking horse simulator apparatus includes a frame that has a first lateral side, a second lateral side and a front end. A hitch connector is attached to the front end. An axle is attached to the frame and a pair of support wheels is attached to opposite ends of the axle. A post is attached to and extends upwardly from the frame. A beam is pivotally coupled to an upper end of the post. A cover is positioned on the beam. A drive wheel is rotatably mounted to the frame. A leg is attached to the drive wheel and to the beam to lift and lower the beam when the drive wheel is rotated. The hitch connector is coupled to a vehicle to pull the frame and rotate the drive wheel to simulate bucking horse to a person seated on the cover.

7 Claims, 6 Drawing Sheets

BUCKING HORSE SIMULATOR APPARATUS

BACKGROUND OF THE DISCLOSURE

Field of the Disclosure

The disclosure relates to bucking horse simulation devices and more particularly pertains to a new bucking horse simulation device for providing a simulated bucking horse movement for instruction and entertainment purposes using a structure that is actuated by being pulled by a vehicle.

SUMMARY OF THE DISCLOSURE

An embodiment of the disclosure meets the needs presented above by generally comprising a frame that has a first lateral side, a second lateral side and a front end. A hitch connector is attached to and extends away from the front end. An axle is attached to the frame. A pair of support wheels is attached to opposite ends of the axle. Each of the first and second lateral sides has one of the support wheels positioned adjacent thereto. A post is attached to and extends upwardly from the frame. The post is spaced from each of the first and second lateral sides and has an upper end. A beam has a first end and a second end. The upper end of the post is pivotally coupled to the beam between the first and second ends. A cover is positioned on the beam. The cover includes a central wall mounted on and extending along an upper surface of the beam and a pair of side walls each attached to and extending downward from the central wall. A drive wheel is rotatably mounted to the frame. A leg is attached to the drive wheel. An arm is attached to the beam between the first end and the post. The arm is attached to the leg at a point spaced from an axis of rotation of the drive wheel so that rotation of the drive wheel alternatively pulls and pushes the arm toward the beam to cause lifting and lowering of the first end of the beam. The hitch connector is coupled to a vehicle to pull the frame and rotate the drive wheel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
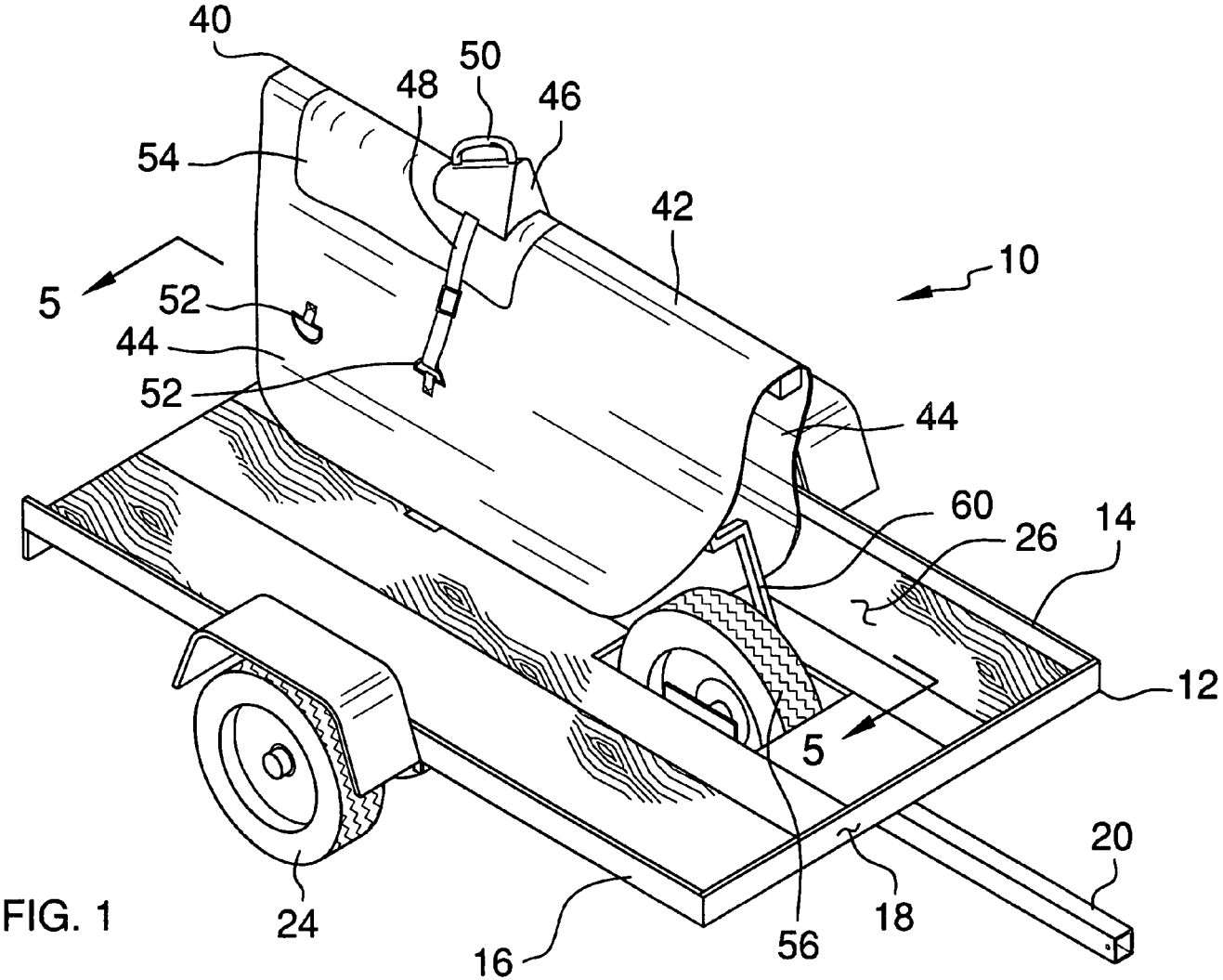
FIG. 1 is a top perspective view of a bucking horse simulator apparatus according to an embodiment of the disclosure.
Figure 2:
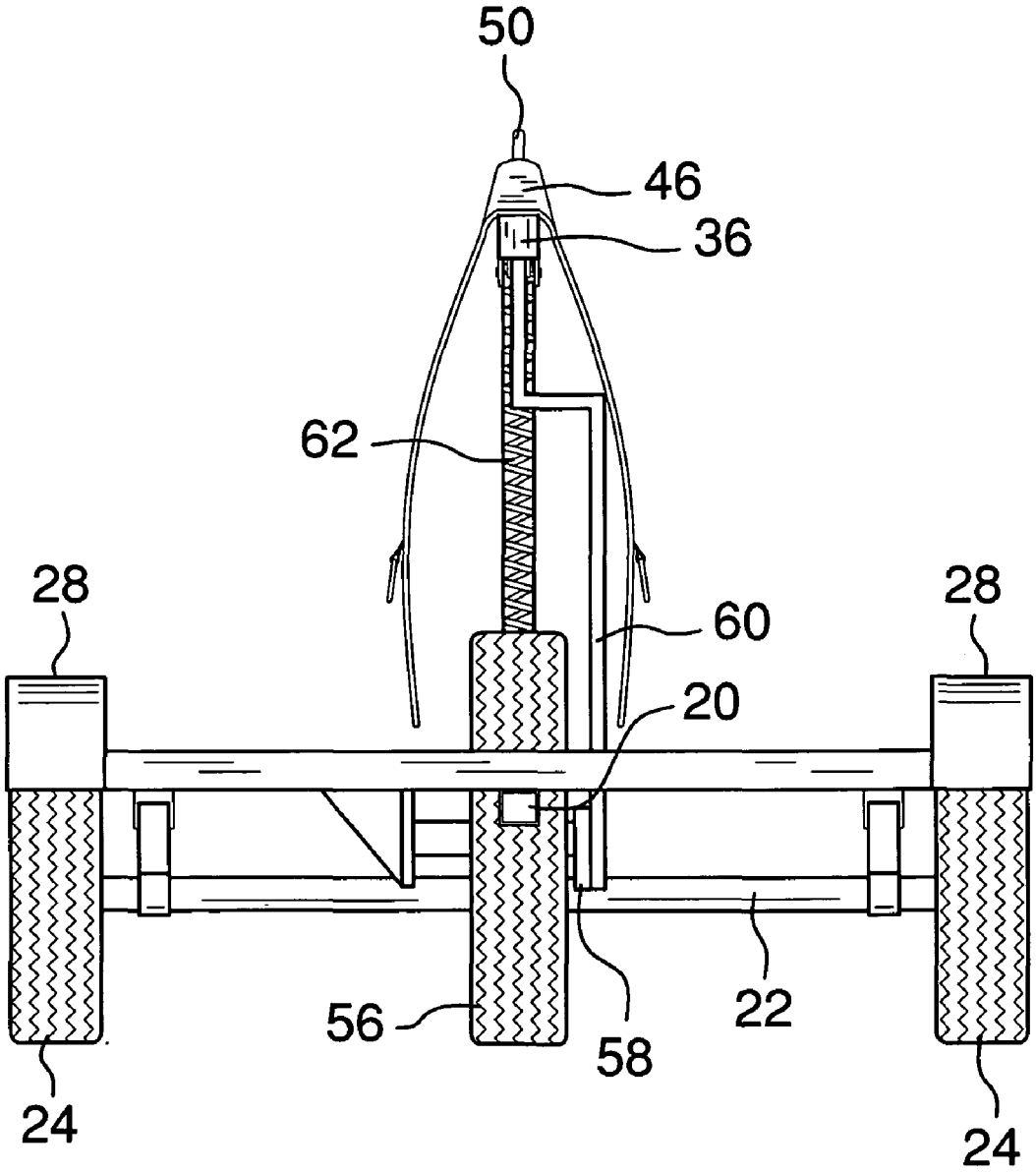
FIG. 2 is a front view of an embodiment of the disclosure.
Figure 3:
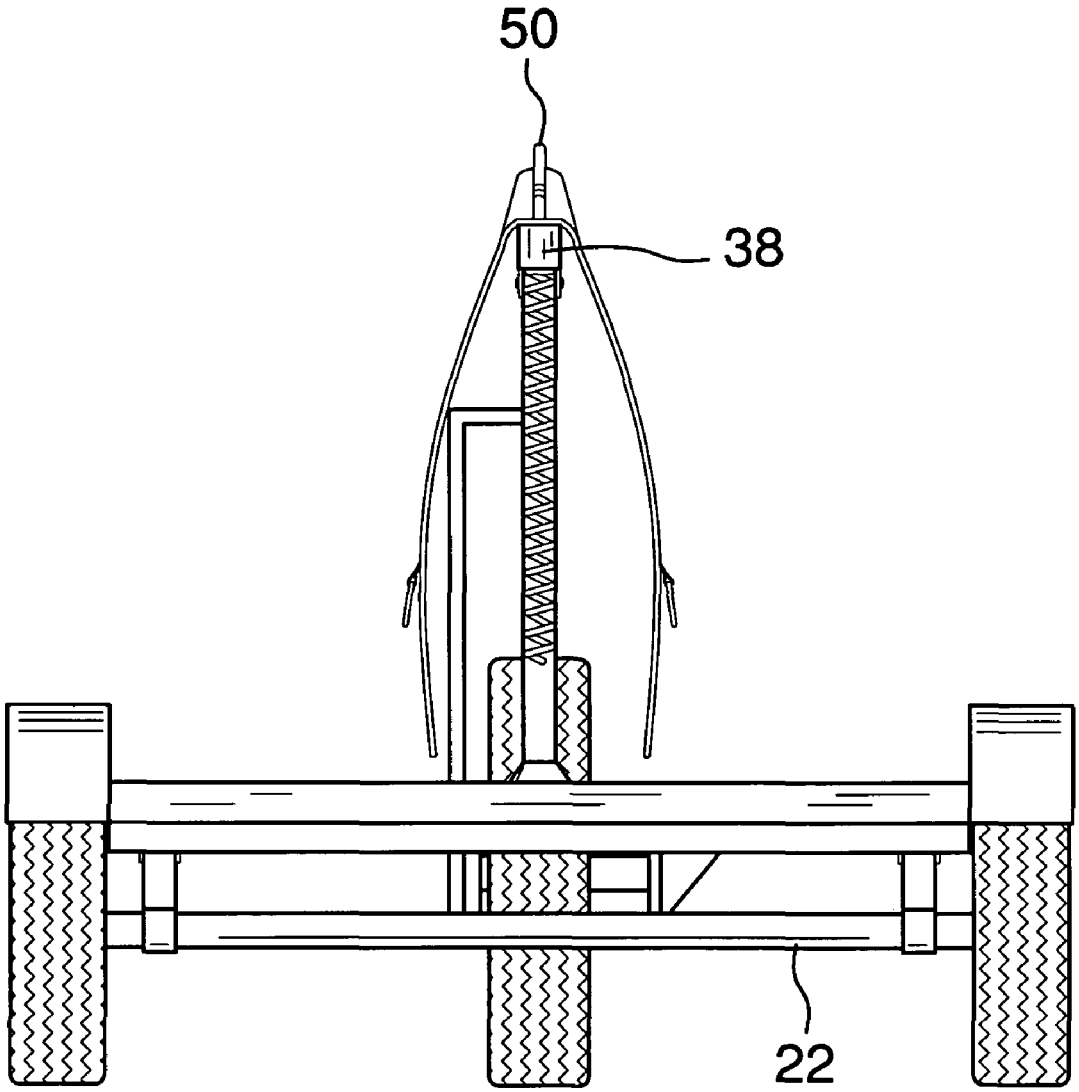
FIG. 3 is a rear view of an embodiment of the disclosure.
Figure 4:
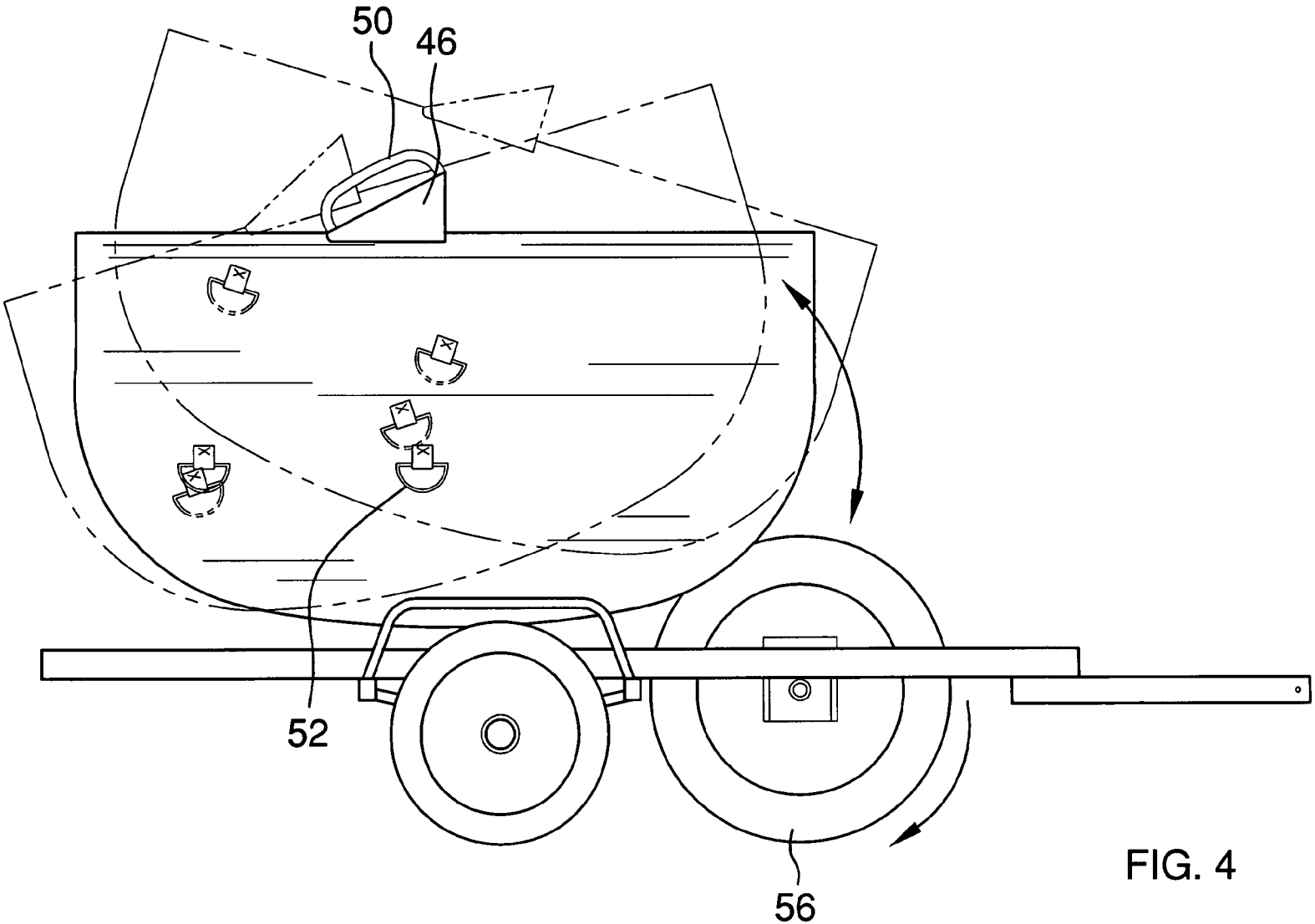
FIG. 4 is a side view of an embodiment of the disclosure.
Figure 5:
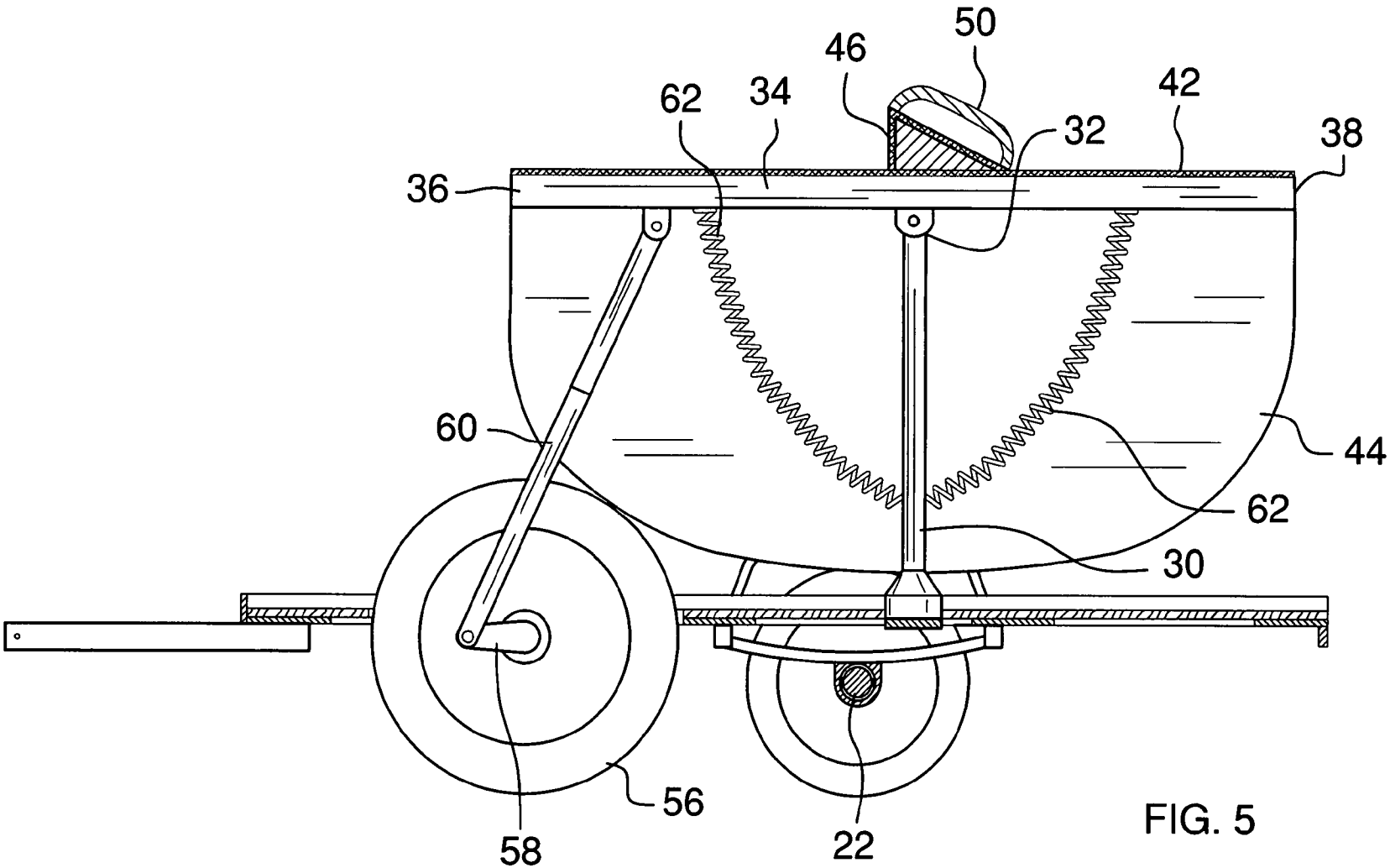
FIG. 5 is a cross-sectional view taken along line 5-5 of FIG. 1 of an embodiment of the disclosure.
Figure 6:
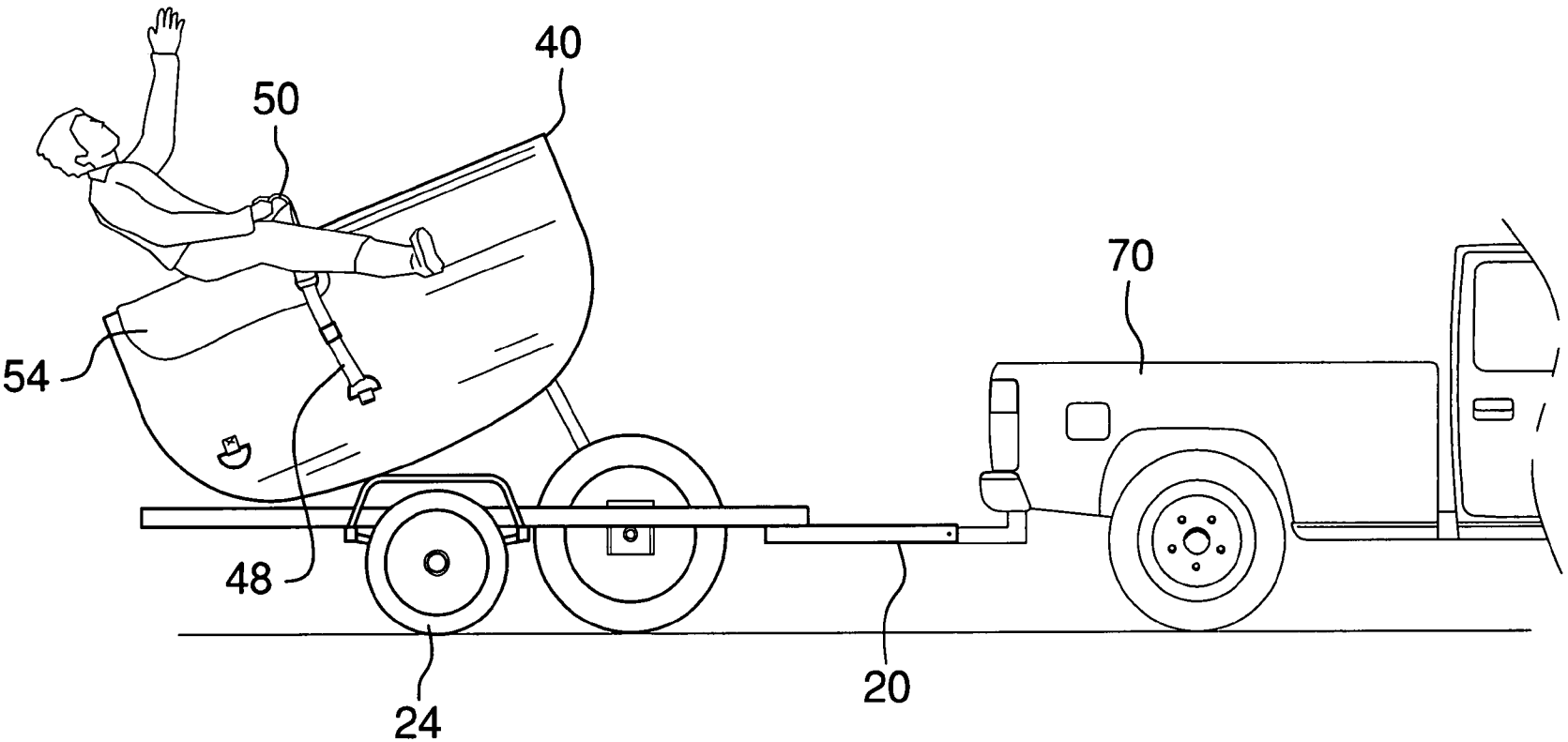
FIG. 6 is a side in-use view of an embodiment of the disclosure.

With reference now to the drawings, and in particular to FIGS. 1 through 6 thereof, a new bucking horse simulation device embodying the principles and concepts of an embodiment of the disclosure and generally designated by the reference numeral 10 will be described.

As best illustrated in FIGS. 1 through 6, the bucking horse simulator apparatus 10 generally comprises a frame 12 that has a first lateral side 14, a second lateral side 16, and a front end 18. A hitch connector 20 is attached to and extends away from the front end 18. An axle 22 is attached to the frame 12. A pair of support wheels 24 is attached to opposite ends of the axle 22. Each of the first 14 and second 16 lateral sides has one of the support wheels 24 positioned adjacent thereto. The frame 12, axle 22, support wheels 24 and hitch connector 20 are generally conventional to trailers. A decking 26 may be positioned on the frame 12 and coverings 28 positioned over the support wheels 24.

A post 30 is attached to and extends upwardly from the frame 12. The post 30 is spaced from each of the first 14 and second 16 lateral sides. The post 30 has an upper end 32. A beam 34 has a first end 36 and a second end 38. The upper end 32 of the post 30 is pivotally coupled to the beam 34 between the first 36 and second ends 38.

A cover 40 is positioned on the beam 34. The cover 40 includes a central wall 42 that is mounted on and extends along an upper surface of the beam 34 and a pair of side walls 44 each being attached to and extending downward from the central wall 42. The side walls 44 each have an outer convex surface. A wedge member 46 is attached to and extends upwardly from the central wall 42. The wedge member 46 may be moved laterally along the central wall 42 to adjust it for the body size of a person sitting on the cover 40. The wedge member 46 may be held down by straps 48 or fasteners. This also allows different wedge members 46 to be positioned on or taken off of the cover 40. A grip 50 is attached to the wedge member 46. A plurality of rings 52 is attached to the cover 40. Each of the side walls 44 has at least one of the rings 52 coupled thereto. The rings 52 may be D-rings and the straps 48 may also be attached to the rings 52. The cover 40 is made from a rigid material, which may be a metallic material, plastic material, fiberglass material, or the like, and the straps 48 may be used for securing the wedge member 46 in place by securing the straps 48 to the rings 52 or by inserting fasteners through the straps 48 attached to the wedge member 46 into the cover 40. A pad 54 is mounted on the cover 40 to provide comfort for a person riding on the cover 40.

A drive wheel 56 is rotatably mounted to the frame 12. A leg 58 is attached to the drive wheel 56. An arm 60 is attached to the beam 34 between the first end 36 and the post 30. The arm 60 is attached to the leg 58 at a point spaced from the an axis of rotation of the drive wheel 56 so that rotation of the drive wheel 56 alternatively pulls and pushes the arm 60 toward the beam to cause lifting and lowering of the first end 36 of the beam 34. This provides the simulation of the movement of a bucking horse as it is being ridden. A plurality of springs 62 is attached to and extends between the beam 34 and the post 30 to bias the beam 34 toward a horizontal orientation. While traveling over uneven ground, the springs 62 help to pull the beam 34 back to a horizontal position.

In use, the hitch connector 20 is coupled to a vehicle 70 to pull the frame 12 and rotate the drive wheel 56. A person sits on the cover 40 and holds the grip 50 while the cover 40 is tilted back and forth. The movement of the vehicle 70 can also be used moving the frame left and right as well as forward and backward though it is presumed that the vehicle 70 will move at relatively low speeds such as less than 10 mph and even less than 5 mph. This will allow a person to learn how to ride a bucking horse in a more controlled manner.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A bucking horse simulation apparatus comprising:

a frame having a first lateral side, a second lateral side, and a front end, a hitch connector being attached to and extending away from said front end;

an axle being attached to said frame, a pair of support wheels being attached to opposite ends of said axle, each of said first and second lateral sides having one of said support wheels positioned adjacent thereto;

a post being attached to and extending upwardly from said frame, said post being spaced from each of said first and second lateral sides, said post having an upper end;

a beam having a first end and a second end, said upper end of said post being pivotally coupled to said beam between said first and second ends;

a cover being positioned on said beam, said cover including a central wall being mounted on and extending along an upper surface of said beam and a pair of side walls each being attached to and extending downward from said central wall;

a drive wheel being rotatably mounted to said frame;

a leg being attached to said drive wheel;

an arm being attached to said beam between said first end and said post, said arm being attached to said leg at a point spaced from an axis of rotation of said drive wheel such that rotation of said drive wheel alternatively pulls and pushes said arm toward said beam to cause lifting and lowering of said first end of said beam; and wherein said hitch connector is coupled to a vehicle to pull said frame and rotate said drive wheel.

2. The apparatus according to claim 1, wherein said side walls each has an outer convex surface.

3. The apparatus according to claim 1, further including a wedge member being attached to and extending upwardly from said central wall.

4. The apparatus according to claim 3, further including a grip being attached to said wedge member.

5. The apparatus according to claim 3, further including a pad being mounted on said cover to provide comfort for a person riding on said cover.

6. The apparatus according to claim 1, further including a plurality of springs being attached to and extending between said beam and said post to bias said beam toward a horizontal orientation.

7. A bucking horse simulation apparatus comprising:

a frame having a first lateral side, a second lateral side, and a front end, a hitch connector being attached to and extending away from said front end;

an axle being attached to said frame, a pair of support wheels being attached to opposite ends of said axle, each of said first and second lateral sides having one of said support wheels positioned adjacent thereto;

a post being attached to and extending upwardly from said frame, said post being spaced from each of said first and second lateral sides, said post having an upper end;

a beam having a first end and a second end, said upper end of said post being pivotally coupled to said beam between said first and second ends;

a cover being positioned on said beam, said cover including a central wall being mounted on and extending along an upper surface of said beam and a pair of side walls each being attached to and extending downward from said central wall, said side walls each having an outer convex surface;

a drive wheel being rotatably mounted to said frame;

a leg being attached to said drive wheel;

an arm being attached to said beam between said first end and said post, said arm being attached to said leg at a point spaced from an axis of rotation of said drive wheel such that rotation of said drive wheel alternatively pulls and pushes said arm toward said beam to cause lifting and lowering of said first end of said beam;

a wedge member being attached to and extending upwardly from said central wall, a grip being attached to said wedge member;

a pad being mounted on said cover to provide comfort for a person riding on said cover;

a plurality of springs being attached to and extending between said beam and said post to bias said beam toward a horizontal orientation; and wherein said hitch connector is coupled to a vehicle to pull said frame and rotate said drive wheel.

* * * * *